US008042447B2

(12) United States Patent
Skurdal et al.

(10) Patent No.: US 8,042,447 B2
(45) Date of Patent: Oct. 25, 2011

(54) ELECTROMAGNETIC INITIATOR COIL

(75) Inventors: Benjamin D. Skurdal, Bel Air, MD (US); Jonathan B. MacNeil, Plymouth, MA (US); Thomas G. Sullivan, Marion, MA (US); Randy L. Gaigler, Parkville, MD (US); Leszek Stanislaw Basak, Nottingham, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 166 days.

(21) Appl. No.: 12/402,989

(22) Filed: Mar. 12, 2009

(65) Prior Publication Data

US 2009/0173328 A1 Jul. 9, 2009

Related U.S. Application Data

(63) Continuation-in-part of application No. 11/535,480, filed on Sep. 26, 2006, now Pat. No. 7,895,931.

(51) Int. Cl.
*F41F 1/00* (2006.01)

(52) U.S. Cl. ..... 89/8; 124/3

(58) Field of Classification Search ..... 89/1.8, 89/1.806, 1.56, 1.814, 28.05, 8; 124/3
See application file for complete search history.

(56) References Cited

U.S. PATENT DOCUMENTS

| | | | |
|---|---|---|---|
| 3,206,652 | A | 9/1965 | Monroe et al. |
| 3,363,508 | A | 1/1968 | Stahmer |
| 4,222,306 | A | 9/1980 | Maury |
| 4,307,665 | A | 12/1981 | Block et al. |
| 4,347,463 | A | 8/1982 | Kemeny et al. |
| 4,432,333 | A | 2/1984 | Kurherr |
| 4,586,439 | A | 5/1986 | Wrana |
| H357 | H | 11/1987 | Howland et al. |
| 4,709,615 | A | 12/1987 | Field |
| 4,791,850 | A | 12/1988 | Minovitch |
| 4,922,800 | A | 5/1990 | Hoffman |
| 4,975,606 | A | 12/1990 | Wu et al. |
| 5,024,137 | A | 6/1991 | Schroeder et al. |
| 5,168,118 | A | 12/1992 | Schroeder |
| 5,217,948 | A | 6/1993 | Leung et al. |
| 5,269,482 | A | 12/1993 | Shearing |
| 5,294,850 | A | 3/1994 | Weh et al. |
| 5,452,640 | A | 9/1995 | Bovee et al. |
| 6,311,926 | B1 | 11/2001 | Powell et al. |
| 6,354,182 | B1 | 3/2002 | Milanovich |
| 6,361,393 | B1 | 3/2002 | Seymour |
| 6,696,775 | B2 | 2/2004 | Engel |
| 7,647,857 | B2 * | 1/2010 | Gaigler et al. ..... 89/8 |

(Continued)

OTHER PUBLICATIONS

David, Michael D., "U.S. Appl. No. 11/535,480 Examiner's Answer Brief Jan. 9, 2009", , Publisher: USPTO, Published in: US.
David, Michael D "U.S. Appl. No. 11/535,480 Office Action Jan. 7, 2008" Publisher: USPTO, Published in: US.
David, Michael D., "U.S. Appl. No. 11/535,480 Office Action May 1, 2008", , Publisher: USPTO, Published in: US.

(Continued)

*Primary Examiner* — Michael David
(74) *Attorney, Agent, or Firm* — DeMont & Breyer, LLC

(57) ABSTRACT

The present invention enables the passive initiation of a deployment sequence for a countermeasure payload. The invention comprises an initiator coil that is positioned inside an electromagnetic countermeasure launcher. When the electromagnetic countermeasure launcher electromagnetically generates propulsive force to propel a payload to its deployment position, inductive coupling between one or more propulsion coils of the launcher and the initiator coil induces current to flow in the initiator coil, which thereby initiates the deployment sequence.

18 Claims, 6 Drawing Sheets

U.S. PATENT DOCUMENTS

| | | | | |
|---|---|---|---|---|
| 7,703,373 | B2 * | 4/2010 | Gaigler et al. | 89/8 |
| 7,895,931 | B2 * | 3/2011 | Gaigler et al. | 89/8 |
| 2006/0011055 | A1 | 1/2006 | Root, Jr. | |
| 2007/0234893 | A1 * | 10/2007 | Lockner et al. | 89/8 |
| 2008/0006144 | A1 * | 1/2008 | Gaigler et al. | 89/8 |
| 2008/0121098 | A1 * | 5/2008 | Gaigler et al. | 89/33.1 |
| 2010/0263648 | A1 * | 10/2010 | Basak et al. | 124/3 |
| 2011/0011252 | A1 * | 1/2011 | Gaigler et al. | 89/1.807 |

OTHER PUBLICATIONS

David, Michael D., "U.S. Appl. No. 11/535,480 Panel Decision Jul. 11, 2008", , Publisher: USPTO, Published in: US.

David, Michael D., "U.S. Appl. No. 11/535,480 Notice of Allowance Jan. 11, 2011", , Publisher: USPTO, Published in: US.

Horner et al., "U.S. Appl. No. 11/535,480 Decision on Appeal Dec. 23, 2010", , Publisher: USPTO, Published in: US.

* cited by examiner

ELECTROMAGNETIC INITIATOR COIL

CROSS REFERENCE TO RELATED APPLICATIONS

This case is a continuation-in-part of co-pending U.S. patent application Ser. No. 11/535,480 filed Sep. 26, 2006, which is incorporated by reference herein.

In addition, the underlying concepts, but not necessarily the language, of U.S. patent application Ser. No. 11/753,426, filed May 24, 2007 are incorporated by reference.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to ordinance launchers in general, and, more particularly, to countermeasure launchers.

BACKGROUND OF THE INVENTION

Countermeasure systems are employed by military vessels to confuse or otherwise frustrate the targeting systems of an approaching missile or similar threat. Countermeasure devices, such as flares, chaff, acoustic emitters, IR emitters, and the like, are deployed to present a false image (i.e., decoy) of the vessel to these targeting systems. The false image is presented so as to draw the threat toward the false image and, therefore, away from the actual vessel. The false image manifests sufficiently far from the actual vessel so that damage caused by the threat when it strikes the decoy is mitigated or avoided all together.

Conventional countermeasure systems utilize arrays of cartridges, each of which carries one or more countermeasure payloads. As part of a representative launch sequence for such a cartidge, a firing circuit provides a first electrical signal to an excitation coil located in the bottom of the launch tube of the cartridge. The energized excitation coil induces a flow of current in a firing coil that is operatively coupled with a chemical-propellant charge. The excited firing coil initiates the ignition of the chemical-propellant, which generates an explosive force that propels the cartridge to its deployment position.

The ignition of the chemical-propellant charge simultaneously initiates a delay timer, which may be either a pyrotechnic delay or an electronic fuse. This delay timer enables the delayed ignition of a bursting charge contained within countermeasure payload. This enables the payload to be deployed appropriately when the cartridge reaches its desired deployment position.

Countermeasure deployment systems known in the prior-art have limited effectiveness against relatively sophisticated sensor platforms, however. This is due to the fact that the ignitions of the chemical-propellant engines used in a conventional countermeasure system emit characteristic launch signatures that have thermal, aural, and visual aspects. In particular, these signatures include a thermal bloom, a cloud of smoke, noise, a thermal trail and a smoke trail. In many cases, the thermal bloom heats the area immediate to the launch area, which results in a residual local thermal signature.

An electromagnetic countermeasure launcher has been developed that, among other things, has little or no launch signature. This electromagnetic countermeasure launcher is described in detail in U.S. patent application Ser. No. 11/535,480, filed Sep. 26, 2006, of which the instant application is a continuation-in-part. By replacing the chemical propulsion system of the prior-art with an electromagnetic propulsion system, however, the means for initiating the delay timer used to ensure proper countermeasure deployment is eliminated.

In order to induce an electric current in a firing coil or activate an electronic fuse, a conventional dedicated firing circuit could be included in the electromagnetic countermeasure launcher. The inclusion of such a circuit, however, reduces overall system reliability, increases control complexity, and add infrastructure cost.

Alternatively, a firing coil or electronic fuse can be initiated by means of an accelerometer in each cartridge. Each accelerometer would sense the acceleration associated with the launch of its cartridge and energize its associated delay timer. Unfortunately, a warship is subject to many sources of shock and vibration (e.g., explosions, collisions, etc.) that could be mistakenly interpreted by the accelerometer as an acceleration associated with payload launch. As a result, this approach increases the possibility of accidentally deploying a payload too early or of launching a payload that will not deploy properly.

SUMMARY OF THE INVENTION

The present invention enables the launch of a payload without some of the costs and disadvantages of the prior art. Embodiments of the present invention are particularly well-suited to countermeasure launch systems. In particular, the present invention provides passive initiation of a deployment sequence during the launch of the payload. Embodiments of the present invention comprise an armature having an initiator coil that is passively energized through inductive coupling with a propulsion coil of an electromagnetic launch system. The initiator coil enables initiation of the deployment sequence due to the flow of a current in the initiator coil. This current inherently develops in the initiator coil in response to a flow of electric current in a propulsion coil of the electromagnetic launch system.

Initiator coils are known in the prior art; however, the initiator coils in the prior art require proactive excitation by an initiator circuit. The initiator circuit energizes an excitation coil that, in turn, induces the flow of electric current in the initiator coil. The need for a proactively actuated initiator circuit leads to potential reliability issues, such as failure to ignite the chemical-propellant or catastrophically igniting the chemical-propellant when not desired. In addition, the need for an initiator circuit adds cost and complexity to the launch control system.

In contrast to the prior art, the present invention provides an initiator coil that obviates the need for a proactive initiator circuit. The initiator coil is included in an armature that is propelled by an electromagnetic launch system to enable the armature to throw a payload to a deployment position. Current in the initiator coil is induced due to inductive coupling with an energized propulsion coil of the electromagnetic launcher. The flow of current in the initiator coil initiates a deployment sequence that enables deployment of a countermeasure contained in the payload. In some embodiments, the flow of current in the initiator coil is directly conveyed into the payload to power on-board electronics such as delay timers, etc. In some embodiments, the flow of current in the initiator coil is inductively coupled with the payload to activate on-board electronics.

An embodiment of the present invention comprises a method comprising: throwing a payload to a deployment position, wherein the payload is thrown by an armature that throws the payload with an electromagnetically generated force whose magnitude is based on the magnitude of a first electric current flowing in a propulsion coil; inducing a flow of a second electric current in an initiator coil, wherein the flow of the second electric current is induced by inductive coupling between the propulsion coil and the initiator coil, and wherein the armature comprises the initiator coil; and initiating a deployment sequence based on the flow of the first electric current.

DETAILED DESCRIPTION

Figure 1:
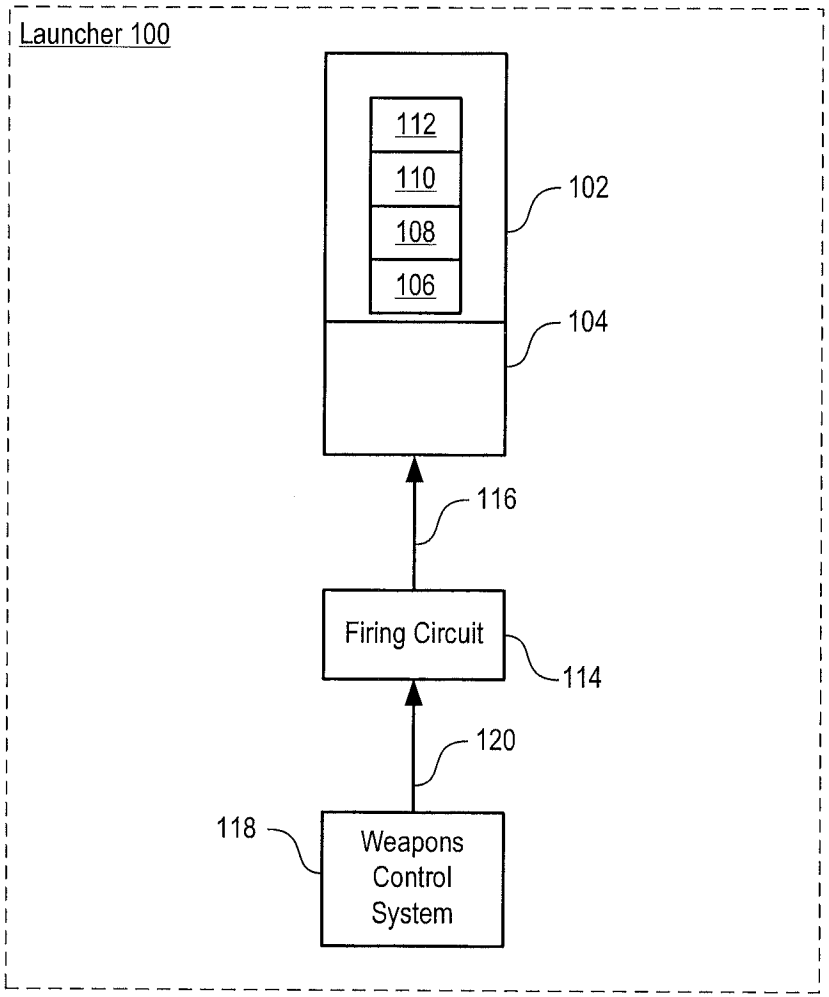
FIG. 1 (Prior Art)
FIG. 1 depicts a block diagram of a portion of a countermeasure launcher in accordance with the prior art.

FIG. 1 depicts a block diagram of a portion of a representative countermeasure launcher in accordance with the prior art. Launcher 100 is a conventional countermeasure launcher that propels payload 102 by explosive force that is generated by propulsion system 104.

Payload 102 comprises activator 106, delay timer 108, bursting charge 110, and countermeasure 112.

Propulsion system 104 comprises a chemical-propellant charge and a firing coil for igniting it. The firing coil is inductively coupled to an excitation coil located in the bottom of the launch tube of the launcher.

At launch, weapons control system 118 provides launch signal 120 to firing circuit 114. Firing circuit 114 energizes the excitation coil within propulsion system 104 with electrical signal 116. The energized exciter coil induces a current in the firing coil, which is typically buried within the chemical-propellant charge, to induce ignition of the chemical-propellant.

Activator 106 is an element that conveys energy from propulsion system 104 to delay timer 108. It may be as simple as a means to convey pressure from the ignited chemical-propellant charge to the delay timer. In some cases, activator 106 may be a mechanism that excites delay timer 108 via mechanical or thermal energy.

Delay timer 108 is a chemical fuse that is operatively coupled to bursting charge 110. Delay timer enables the detonation of bursting charge 110 after a time delay from launch sufficient to enable payload 102 to travel some distance from the host warship before countermeasure 112 is deployed.

Bursting charge 110 is a mass of explosive material that is positioned within payload 102 such that countermeasure 112 is deployed when bursting charge 110 is detonated.

Countermeasure 112 is a device that is intended to frustrate the sensors of an incoming threat, such as a missile. Countermeasure 112 provides an indication of the presence of a vessel to the sensors of an approaching threat by passively reflecting a signal (e.g., chaff that reflects radar signals, etc.) or actively producing a signal (e.g., flares that emit light and heat, explosives that emit acoustic and thermal energy, etc.). For the purposes of this specification, including the appended claims, the phrase "provide a signal" means either passively reflecting or actively producing a signal. In some cases, payload 102 may include one or more countermeasure devices of one or more types.

In operation, launcher 100 propels payload 102 by means of explosive force. The explosive force is generated by inducing the chemical-propellant charge in propulsion system 104 to ignite. The rapidly expanding gasses generated by chemical-propellant charge propel payload 102 to a deployment position. The deployment position is determined by: (1) the position and orientation of the host warship at launch; (2) the angle at which payload 102 is launched; (3) the azimuth at which payload 102 is launched; and (4) the fixed amount of propulsive force that the chemical-propellant charge generates. The deployment position is typically sufficiently distant from the host warship to avoid damage to the warship from an incoming missile that explodes at the deployment position.

Launcher 100 has drawbacks. First, the fact that the propulsive force used to propel payload 102 is fixed requires that, in most case, the host warship must execute a series of complicated maneuvers to develop an effective decoy. Second, the fact that payload 102 is launched using explosive force results in a characteristic launch signature that can enable an incoming threat to differentiate between a deployed decoy and the host warship.

The present invention is a countermeasure launcher that propels payloads using electromagnetically generated force rather than explosive force. As a result, the present invention enables the propulsion of a payload with electrically controllable force and little or no launch signature. The present invention, therefore, does not require a firing circuit to initiate ignition of a chemical-propulsion engine. Since this firing circuit is also used in conventional countermeasure systems to activate delay timer 108, an electromagnetic countermeasure launcher must activate delay timer 108 using either a dedicated firing circuit or some alternative means. Since a dedicated firing circuit represents a potential failure point in the system, the present invention provides an alternative means for activating delay timer 108.

The present invention enables delay timer to be energized in a passive manner that is inherent to the propulsion of payload 102. As a result, launchers in accordance with the present invention can be characterized by:

i. a simpler control system; or
ii. a lack of a dedicated initiator circuit; or
iii. lower cost; or
iv. higher reliability; or
v. controllable propulsive force; or
vi. a deployment sequence having greater functionality; or
vii. any combination of i, ii, iii, iv, v, and vi.

Figure 2:
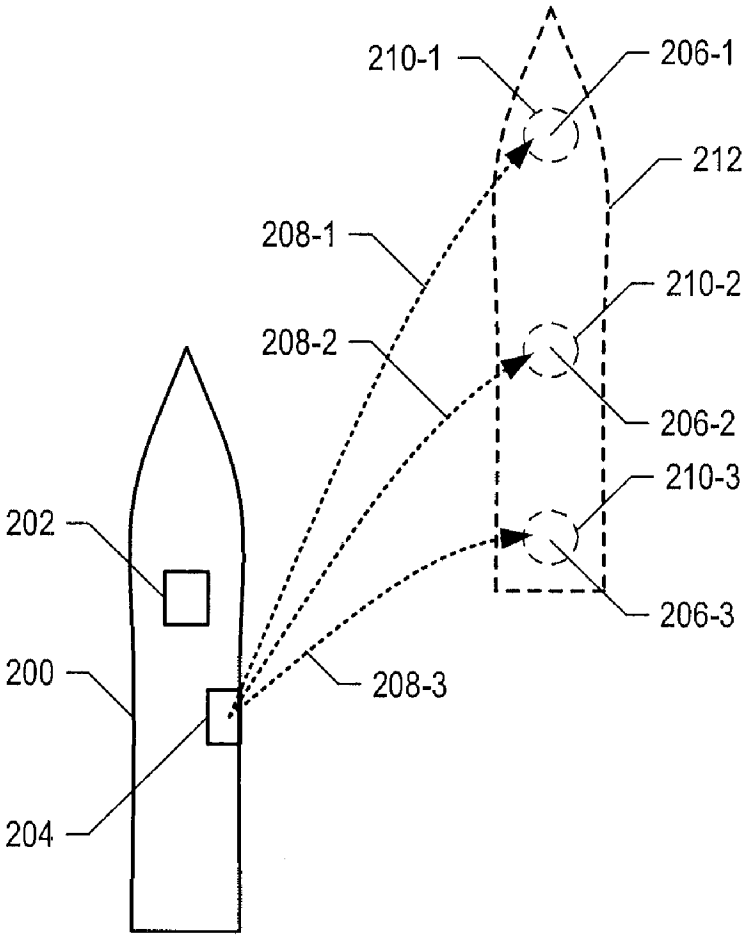
FIG. 2 depicts a schematic diagram of a warship deploying countermeasure payloads in accordance with an illustrative embodiment of the present invention.

FIG. 2 depicts a schematic diagram of a warship deploying countermeasure payloads in accordance with an illustrative embodiment of the present invention. Warship 200 carries radar tracking system 202 and launch system 204.

Radar tracking system 202 is a system that detects and tracks potential threats and provides an estimate of their velocity and path, as is well-known in the art.

Launch system 204 is described in detail below and with respect to FIGS. 3 and 4.

In response to the detection of an approaching threat by radar tracking system 202, launch system 204 launches a series of countermeasure payloads, 206-1, 206-2, and 206-3 (referred to collectively as "payloads 206").

Launch system 204 launches payloads 206-1, 206-2, and 206-3 on paths 208-1, 208-2, and 208-3, respectively, so as to coordinate the timing of their deployment at their respective deployment positions 210-1, 210-2, and 210-3. In some cases, it is desirable to have payloads 206 deploy simultaneously at the position of decoy 212. In some embodiments, the deployment of payloads 206 is based upon the type and path of the incoming threat.

Launch system 204 deploys payloads 206 to their respective deployment positions, each at a specific time, so that they collectively provide an image of decoy 212 to the sensors of an approaching threat. In some embodiments of the present invention, countermeasure payloads, 206-1, 206-2, and 206-3 provide signals of different types in order to frustrate and/or confuse a multi-spectral sensor capability of an incoming threat.

Figure 3:
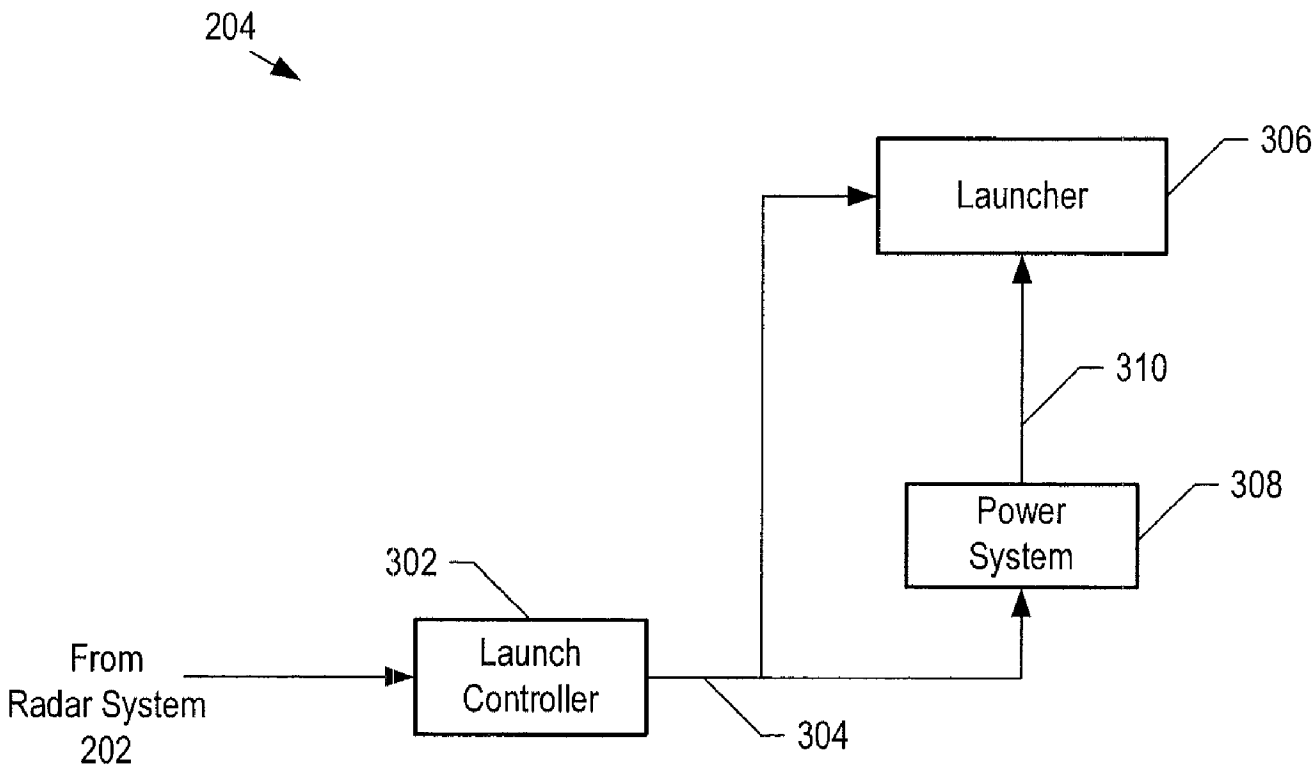
FIG. 3 depicts a schematic diagram of a countermeasure launch system in accordance with the illustrative embodiment of the present invention.

FIG. 3 depicts a schematic diagram of a countermeasure launch system in accordance with the illustrative embodiment of the present invention. Launch system 204 is a system that has the capability to launch a payload upon command. The system expels the payload from a launch tube using an electromagnetic catapult and without the aid of explosive force. This is advantageous because the payload is launched without a substantial launch signature, which can diminish the effectiveness of a deployed decoy. Further, an electromagnetic countermeasure launcher affords an ability to control the amount of force used to propel each payload. These advantages enable one or more countermeasure payloads to be deployed at desired coordinates at a desired time, and without an indication of the payloads' origin. Countermeasure launch system 204 comprises controller 302, launcher 306, and power system 308.

Controller 302 is a general purpose controller for receiving signals and information from radar system 202 and providing targeting information and firing control signals to launcher 306 and power system 308. It will be clear to those skilled in the art, after reading this specification, how to make and use controller 302.

Launcher 306 is a launcher which uses an electromagnetic force to propel payloads. The propulsive force, azimuth, and elevation of launcher 306 are controllable to enable it to propel a countermeasure payload to any desired point within its range.

Control cable 304 carries signals and control information, such as azimuth, elevation, and desired force magnitude, from controller 302 to launcher 306 and power system 308.

Power system 308 comprises circuitry that conditions and manages the storage and delivery of power to launcher 306 in response to signals from controller 302. Power system 308 controls power generation, storage, and delivery prior to, during, and after each launch. Power system 308 provides an amount of power to launcher 306 suitable to enable it to propel a payload on its desired path (e.g., one of paths 208-1, 208-2, or 208-3). It will be clear to those skilled in the art, after reading this specification, how to make and use power system 308.

Current cable 310 carries power from power system 308 to launcher 306. In some embodiments of the present invention that comprise multiple electromagnetic launch tubes, current cable 310 is capable of carrying power to each electromagnetic launch tube independently from the other electromagnetic launch tubes.

Figure 4:
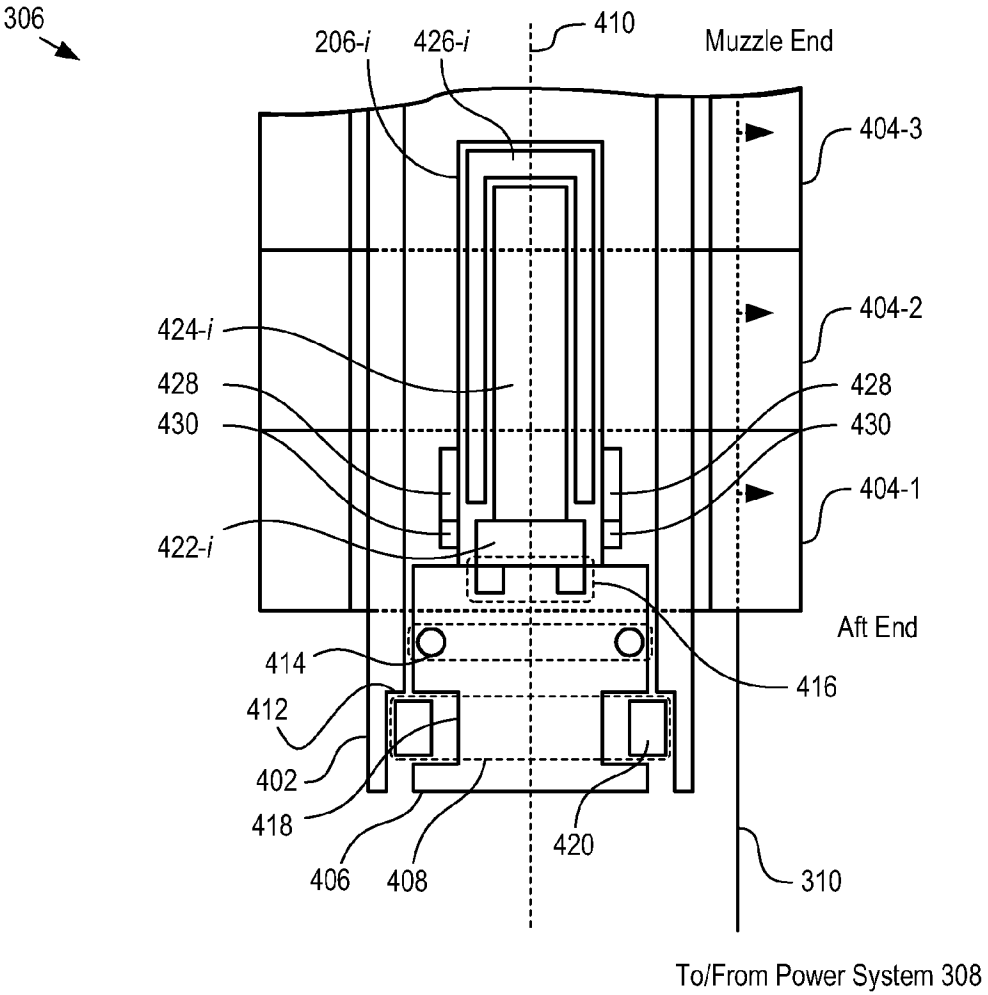
FIG. 4 depicts a schematic diagram of details of launcher 306.

FIG. 4 depicts a schematic diagram of details of launcher 306. Launcher 306 comprises launch tube 402, propulsion coils 404-1, 404-2, and 404-3, armature 406, and restraint 408. In some embodiments, launcher 306 further comprises a breech loading system and a munitions storage magazine. For clarity, launcher 306 is depicted without a breech loader and magazine.

Figure 5:
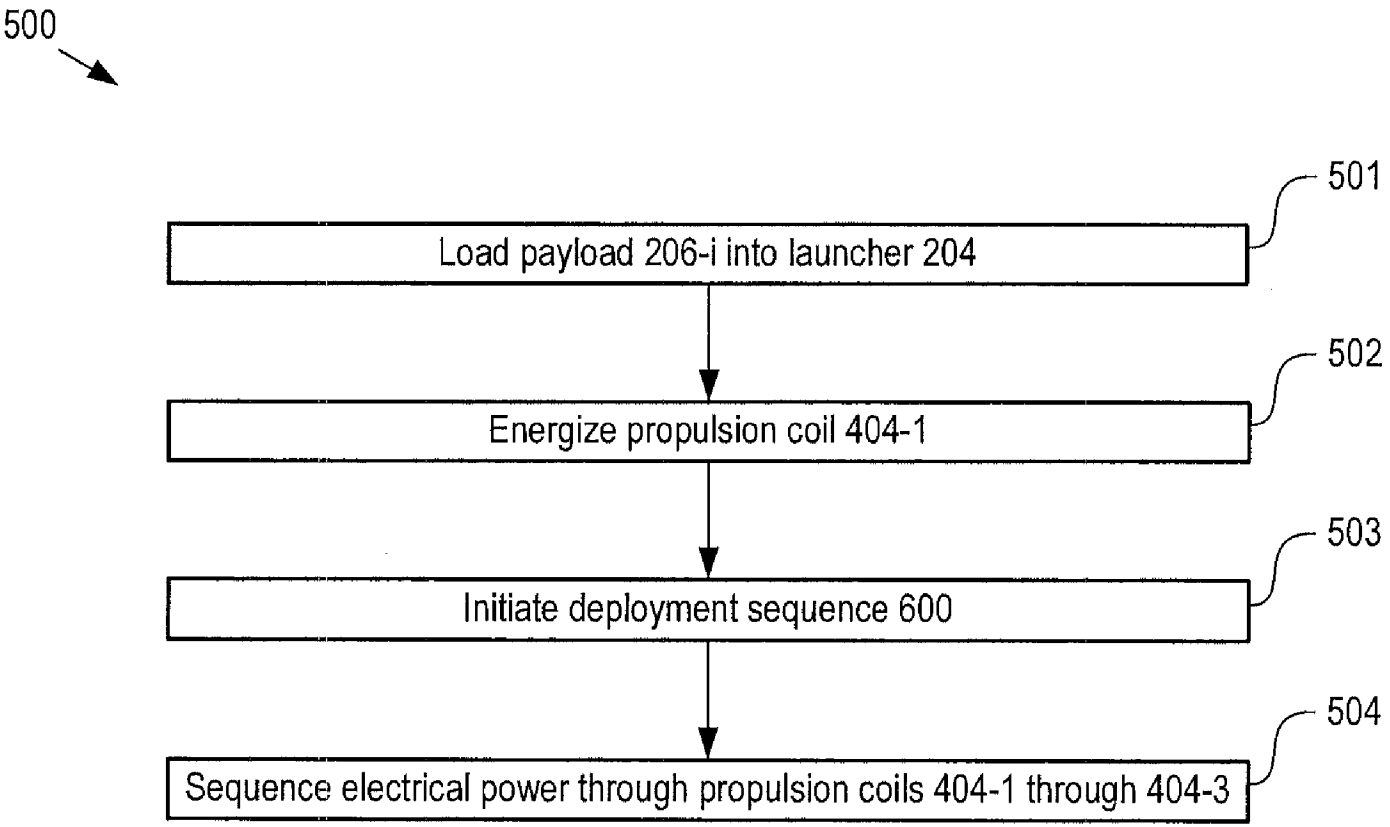
FIG. 5 depicts a method comprising operations for launching a payload in accordance with the illustrative embodiment of the present invention.

FIG. 5 depicts a method comprising operations for launching a payload in accordance with the illustrative embodiment of the present invention. FIG. 5 is described with continuing reference to FIGS. 3 and 4.

Method 500 begins with operation 501, wherein payload **206-*i* is physically coupled with armature 406. Prior to launch, armature 406 is located within launch tube 402. Launch tube 402 is surrounded by propulsion coils 404-1, 404-2, and 404-3 (collectively referred to as propulsion coils 404). Armature 406 is restrained at the aft end of launch tube 402 by restraint 408**.

Launch tube 402 is a cylindrical tube that has sufficient interior diameter to accommodate payload 206-i, armature 406, and restraint 408, and sufficient strength to withstand the forces exerted on launch tube 402 during a payload launch. Launch tube 402 is formed of material that is non-magnetic so that it does not perturb mutual induction between propulsion coils 404 and either of armature 406 or restraint 408. Launch tube 402 guides armature 406 as it propels payload 206-i along launch axis 410 during a launch.

Launch tube 402 comprises shoulder 412. In some embodiments, shoulder 412 is formed by boring the aft end of launch tube 402 to a larger diameter than the muzzle portion of launch tube 402. In some embodiments, shoulder 412 is formed by one or more detents in the wall of launch tube 402.

Each of propulsion coils 404 is a length of electrical conductor that is suitable for carrying sufficient electric current to accelerate armature 406. The propulsive force provided by each of coils 404 to armature 406 is a function of the number of turns it contains, the current it carries, and the separation between it and armature 406.

Armature 406 is a rigid platform suitable for holding countermeasure payload 206-i, wherein i is a positive integer in the set $\{1, 2, 3\}$. One skilled in the art will recognize that in some alternative embodiments, i can be a member of a set having any suitable number of elements. Armature 406 comprises a non-magnetic material, armature coil 414, and initiator coil 416. Armature coil 414 is analogous to each of propulsion coils 404. The magnitude of the propulsive force directed on armature 406 is a function of the mutual inductance between armature 406 and propulsion coils 404. The magnitude of the force directed on armature 406 is a function of the mutual inductance of armature coil 414 and coils 404. Armature 406 comprises seat 418, which receives hoop 420.

In some embodiments armature 406 comprises a material that is capable of developing a mutual inductance with a magnetic field generated by the flow of current in any of coils 404. In such embodiments, armature 406 typically comprises a magnetic material such as iron, steel, Permalloy, etc.

Initiator coil 416 is a length of electrical conductor wound into a circular arrangement to facilitate inductive coupling with propulsion coil 404 so as to induce a flow of electric current in initiator coil 416.

Payload 206-i is a countermeasure for deploying a cloud of chaff at its deployment position. Payload 206-i comprises delay timer 422-i, bursting charge 424-i, and chaff canister 426-i. It will be clear to one skilled in the art, after reading this specification, how to make and use embodiments of the present invention wherein payload 206-i is other than a countermeasure for deploying a cloud of chaff.

Restraint 408 is a restraint that passively actuates to release armature 406 when in the presence of magnetic field that is developed by a sufficient flow of electric current through propulsion coil 404-1. Restraint 408 comprises hoop 418, seat 420, and shoulder 412.

Prior to launch, restraint 408 is in a first position, wherein hoop 418 is engaged with shoulder 412. When hoop 418 and shoulder 412 are engaged, armature 406 is substantially immobilized with respect to launch axis 410 and propulsion coil 404-1.

At operation 502, launch controller 302 provides signal 304 to power system 308 and launcher 306. In response, launcher 306 adjusts its azimuth and elevation and power system energizes propulsion coils 404 with a current flow suitable to propel payload 206-i with a desired force.

When propulsion coil 404-1 is energized, the flow of electric current through the coil generates a magnetic field directed along launch axis 410. This magnetic field induces the flow of electric current in armature coil 414, initiator coil 416, and hoop 420.

At operation 503, a deployment sequence is initiated in response to the flow of current in propulsion coil 404-1.

Figure 6:
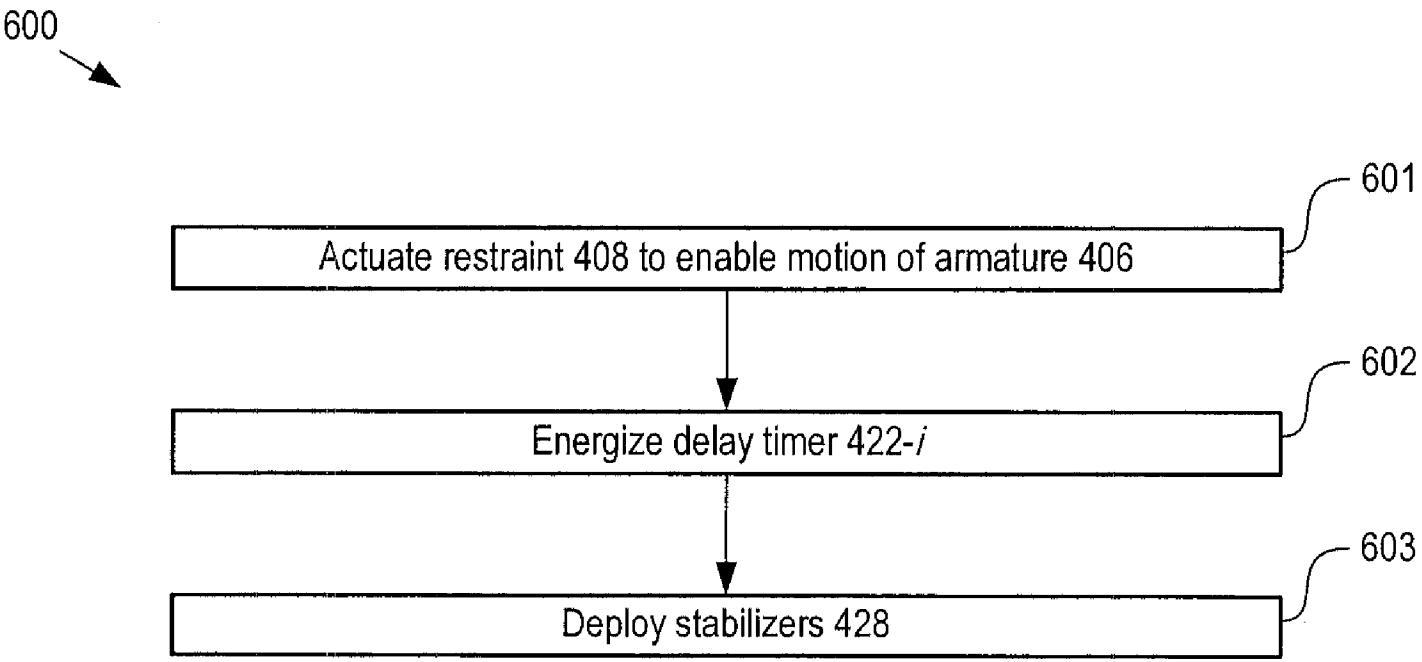
FIG. 6 depicts a deployment sequence in accordance with the illustrative embodiment of the present invention.

FIG. 6 depicts a deployment sequence in accordance with the illustrative embodiment of the present invention. Deployment sequence 600 comprises: operation 601, wherein restraint 408 is actuated to enable motion of payload 206-i; operation 602, wherein delay timer 422-i is energized; and operation 603, wherein actuation of actuators 430 is initiated to deploy stabilizers 428. It should be noted that deployment sequence 600 is initiated passively as an inherent consequence of the flow of current in propulsion coil 404-1. As a result, the present invention obviates the need for dedicated initiator circuit 122 described above and with respect to FIG. 1 and the prior art.

One skilled in the art will recognize that deployment sequence 600 is merely exemplary and that other deployment sequences having additional or fewer operations are anticipated in accordance with the present invention. Further the operations of a deployment sequence can typically occur in any order. Each of operations 601 through 603 is described in more detail below and with continuing reference to FIGS. 3, 4, and 5.

At operation 601, restraint 408 is actuated and moves to a second position in which restraint 408 is disengaged from shoulder 412. Restraint 408 is actuated through inductive coupling between hoop 420 and energized propulsion coil 404-1. As a result of this inductive coupling, a compressive force is induced on hoop 420. This force drives hoop 420 into seat 418, thereby disengaging it from shoulder 412. As a result of operation 601, motion of armature 402 and payload 206-i, with respect to launch axis 410, is enabled.

At operation 602, a flow of current is generated in initiator coil 416. This flow of current results from inductive coupling between energized propulsion coil 404-1 and initiator coil 416. Initiator coil 416 is electrically connected to delay timer 422-i when payload 206-i and armature 406 are physically coupled. The flow of current in initiator coil 416 initiates operation of delay timer 422-i. In some embodiments, initiator coil 416 and delay timer 422-i are not in direct electrical connection and operation of delay timer 422-i is initiated by means of inductive coupling. In some embodiments, delay timer 422-i comprises a power system, such as a battery, that provides power to additional electrical devices, such as a guidance computer, flight control elements, and the like.

At operation 603, delay timer 422-i initiates actuation of actuators 430 to deploy stabilizers 428. Delay timer 422-i initiates actuation of actuators 430 once payload 206-i has cleared the muzzle end of launch tube 402. The deployment of stabilizers 428 enable aerodynamic flight of payload 206-i during its flight to deployment position 210-i.

At operation 504, power system 308 controls and sequences current flow through propulsion coils 404-1 through 404-3 to maintain acceleration of payload 206-i throughout the launch event.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus configured to throw a payload to a deployment location, wherein the payload comprises a delay timer, the apparatus comprising:

a propulsion coil, wherein the propulsion coil is substantially concentric about a line;

an armature, wherein the armature comprises an initiator coil, and wherein the armature further comprises a first physical adaptation configured to enable motion of the armature along the line, and further wherein the armature and the propulsion coil are not electrically connected;

wherein the flow of a first electric current in the propulsion coil induces the armature to move along the line and to throw the payload to the deployment position;

wherein the flow of the first electric current induces the flow of a second electric current in the initiator coil; and wherein the flow of the second electric current initiates a deployment sequence comprising initiating operation of the delay timer.

2. The apparatus of claim 1 further comprising the payload, wherein the payload comprises:

an initiator; and a countermeasure, wherein the countermeasure comprises a second physical adaptation that enables it to deploy when the payload is at the deployment position, and wherein the payload deploys as part of the deployment sequence;

wherein the initiator coil and the initiator are electrically coupled when the payload and the armature are physically coupled.

3. The apparatus of claim 2 wherein the payload further comprises an actuator and a stabilizer, wherein the actuator comprises a third physical adaptation for moving the stabilizer from a first position to a second position as part of the deployment sequence, and wherein the stabilizer enables aerodynamic flight of the payload when the stabilizer is in the second position.

4. The apparatus of claim 1 wherein the armature further comprises an armature coil, and wherein the first flow of the first electric current in the propulsion coil induces a third flow of electric current in the armature coil, and further wherein the first flow of electric current and the third flow of electric current collectively induce a force that moves the armature along the line and to throw the payload to the deployment position.

5. The apparatus of claim 1 further comprising a restraint, wherein the restraint has a first position and a second position, and wherein the restraint substantially immobilizes the payload with respect to the line when the restraint is in the first position, and wherein the restraint enables motion of the payload along the line when the restraint is in the second position, and further wherein the restraint moves from the first position to the second position as part of the deployment sequence.

6. The apparatus of claim 1 further comprising a restraint, wherein the restraint has a first position and a second position, and wherein the restraint substantially immobilizes the payload with respect to the line when the restraint is in the first position, and wherein the restraint enables motion of the payload along the line when the restraint is in the second position, and further wherein motion of the restraint from the first position to the second position is induced by the flow of the first current.

7. The apparatus of claim 1 wherein the armature further comprises an armature coil, and wherein the armature coil and the propulsion coil are not electrically connected, and wherein the flow of the first current induces a flow of a third current in the armature coil, and further wherein the flow of the first current and the flow of the third current mutually induces motion of the armature along the line.

8. An apparatus configured to throw a payload to a deployment location, wherein the payload comprises a delay timer, the apparatus comprising:

a propulsion coil, wherein the propulsion coil is substantially concentric about a line;

an armature that is electrically disconnected from the propulsion coil, the armature being movable along the line, the armature and propulsion coil configured such that inductive coupling between them induces a propulsive force on the armature along the line; and an initiator coil, the initiator coil and propulsion coil configured such that inductive coupling between them induces a first electric current in the initiator coil;

wherein the delay timer and initiator coil are configured such that the first electric current initiates operation of the delay timer.

9. The apparatus of claim 8 further comprising the payload, wherein the payload comprises:

an initiator that is electrically coupled with the delay timer; and a countermeasure.

10. The apparatus of claim 9 wherein the payload further comprises:

a stabilizer; and an actuator, the actuator being physically adapted to move the stabilizer from a first position to a second position in which the stabilizer enables aerodynamic flight of the payload.

11. The apparatus of claim 8 wherein the armature further comprises an armature coil, the armature coil and the propulsion coil being arranged such that inductive coupling between them is enabled, wherein inductive coupling of the armature coil and propulsion coil induces the propulsive force.

12. The apparatus of claim 8 further comprising a restraint, the restraint and the propulsion coil being arranged such that inductive coupling between them moves the restraint from a first position to a second position, wherein the restraint substantially immobilizes the armature with respect to the line when in the first position, and wherein the restraint enables motion of the armature along the line when in the second position.

13. A method for throwing a payload to a deployment location, the method comprising:

providing a propulsion coil that is substantially concentric about a line, an armature that is electrically disconnected from the propulsion coil, and an initiator coil that is electrically coupled with a delay timer, the payload comprising the delay timer, wherein the propulsion coil, the armature, and the initiator coil are arranged such that inductive coupling between the propulsion coil and each of the armature and the initiator coil is enabled; and flowing a first current in the propulsion coil, wherein the flow of the first current induces the armature to move along the line and to throw the payload to the deployment location; and enabling the flow of a second current in the initiator coil, wherein the flow of the first current induces the flow of the second current;

wherein the flow of the second current initiates a deployment sequence that initiates operation of the delay timer.

14. The method of claim 13 further comprising providing the payload such that the payload comprises a countermeasure, the payload being physically coupled with the armature.

15. The method of claim 13 further comprising:

providing a restraint having (1) a first position in which the restraint restrains motion of the armature along the first line and (2) a second position in which the restraint enables motion of the armature along the first line, wherein the restraint and the propulsion coil are arranged such that inductive coupling between them is enabled;

restraining motion of the armature along the first line via the restraint, wherein the restraint is in the first position; and moving the restraint to the second position, wherein the first current induces the restraint to move from the first position to the second position.

16. The method of claim 13 further comprising controlling the magnitude of the first current to control the magnitude of the propulsive force.

17. The method of claim 13 wherein the deployment sequence comprises:

enabling motion of the armature along the line;

propelling the payload toward the deployment location, wherein the payload comprises a countermeasure and a bursting charge, and wherein the payload is propelled by the armature;

deploying a stabilizer that facilitates aerodynamic flight of the payload; and enabling detonation of the bursting charge at the deployment location.

18. The method of claim 13 wherein the deployment sequence includes deployment of a stabilizer, wherein the payload comprises the stabilizer.

* * * * *